United States Patent [19]

Spaulding

[11] 4,112,891

[45] Sep. 12, 1978

[54] TEMPERATURE COMPENSATED INTERNAL COMBUSTION ENGINE IGNITION SPARK VACUUM ADVANCE SYSTEM

[75] Inventor: James R. Spaulding, Troy, Mich.

[73] Assignee: General Motors Corporation, Detroit, Mich.

[21] Appl. No.: 734,532

[22] Filed: Oct. 21, 1976

[51] Int. Cl.[2] ..... F02P 5/12

[52] U.S. Cl. ..... 123/117 A; 123/146.5 A

[58] Field of Search ..... 123/117 A, 97 B, 117 R, 123/146.5 A

[56] References Cited

U.S. PATENT DOCUMENTS

| | | | |
|---|---|---|---|
| 3,494,338 | 4/1968 | Reise | 123/117 A |
| 3,712,279 | 1/1973 | Vartanian | 123/117 A |
| 3,730,154 | 5/1973 | Vartanian | 123/117 A |
| 3,828,743 | 8/1974 | Ludwig | 123/117 R |
| 3,998,192 | 12/1976 | Ota | 123/117 A |
| 4,031,869 | 6/1977 | Onishi et al. | 123/117 A |
| 4,034,726 | 7/1977 | Falge | 123/117 A |

*Primary Examiner*—Charles J. Myhre
*Assistant Examiner*—P. S. Lall
*Attorney, Agent, or Firm*—Richard G. Stahr

[57] ABSTRACT

The ignition spark initiating mechanism of the ignition distributor is operated by a vacuum responsive device for adjusting ignition spark timing in response to engine vacuum. A temperature responsive valve located in a position at which it is exposed to engine intake air and a bleed line including a calibrated restriction are arranged in combination to expose the engine vacuum signal applied to the intake port of the vacuum actuator unit to atmosphere through the inlet and outlet ports of the temperature responsive valve. This combination operates to adjust the level of the engine vacuum applied to the vacuum responsive device proportionally with changes of engine intake air temperature in a direction toward atmosphere as the temperature of the engine intake air increases and vice versa.

4 Claims, 5 Drawing Figures

TEMPERATURE COMPENSATED INTERNAL COMBUSTION ENGINE IGNITION SPARK VACUUM ADVANCE SYSTEM

This invention relates to an internal combustion engine ignition spark vacuum advance system and, more specifically, to a temperature compensated internal combustion engine ignition spark vacuum advance system.

With prior art internal combustion engine ignition spark vacuum advance systems, the ignition distributor ignition spark initiating mechanism is operated to adjust ignition spark timing in response to changes of engine vacuum by the operating rod of a vacuum actuator unit of the type which provides ignition spark vacuum advance as determined by a single preselected vacuum advance curve regardless of ambient temperature. As is well known in the automotive art, an internal combustion engine should be provided with increasing ignition spark vacuum advance as the engine intake air temperature decreases and vice versa. Therefore, the provision of a temperature compensated internal combustion engine ignition spark vacuum advance system which provides ignition spark vacuum advance as determined by any one of a plurality of ignition spark vacuum advance curves as determined by engine intake air temperature is desirable.

It is, therefore, an object of this invention to provide an improved internal combustion engine ignition spark vacuum advance system.

It is another object of this invention to provide an improved internal combustion engine ignition spark vacuum advance system which is temperature compensated.

It is a further object of this invention to provide an improved internal combustion engine ignition spark vacuum advance system which is temperature compensated to provide a plurality of ignition spark vacuum advance curves as determined by engine intake air temperature.

In accordance with this invention, an improved temperature compensated internal combustion engine ignition spark vacuum advance system is provided wherein an engine intake air temperature sensitive valving arrangement is provided for adjusting proportionally the level of the engine vacuum signal applied to the vacuum responsive device which operates the ignition spark initiating mechanism with changes of engine intake air temperature.

For a better understanding of the present invention, together with additional objects, advantages and features thereof, reference is made to the following description and accompanying drawings in which:

FIG. 1 sets forth the improved temperature compensated internal combustion engine ignition spark vacuum advance system of this invention is schematic form;

Figure 1:
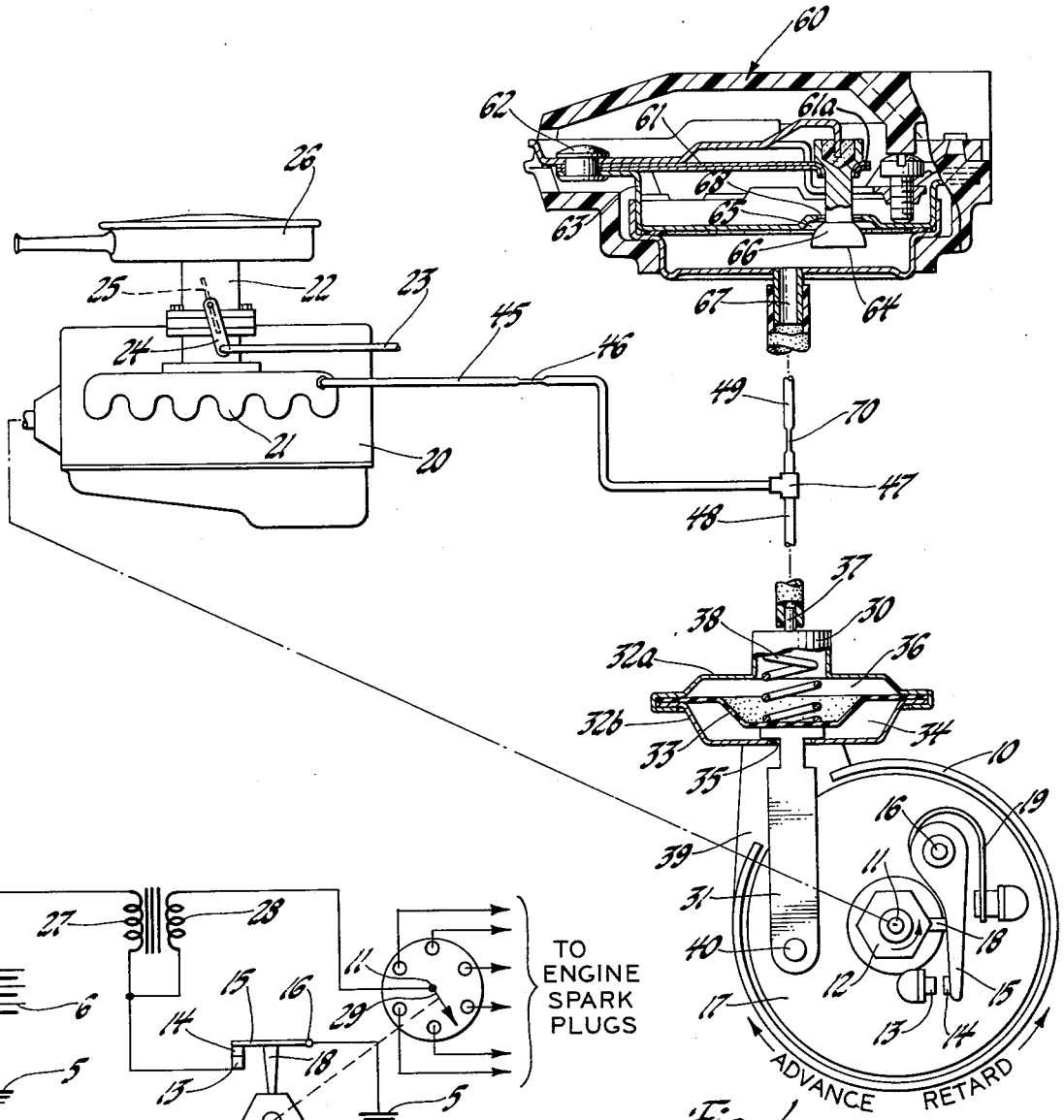
Figure 2:
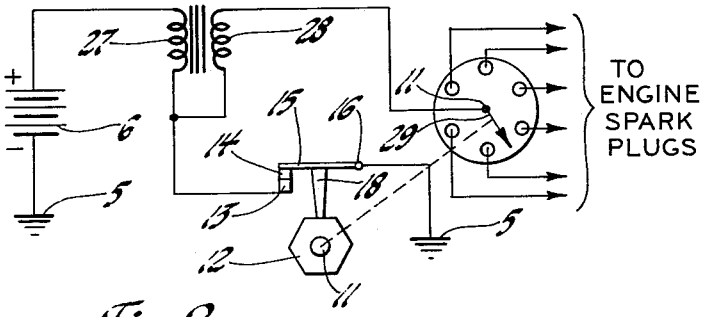
FIG. 2 is a schematic illustration of a conventional automotive type ignition system.

In FIGS. 1 and 2 of the drawings, like elements have been assigned like characters of reference.

In the interest of reducing drawing complexity, certain parts of the ignition distributor of FIG. 1 which are not associated with the ignition spark vacuum advance system of this invention have not been illustrated.

The operation of the temperature compensated internal combustion engine ignition spark vacuum advance system of this invention is described in this specification with regard to a conventional internal combustion engine ignition distributor of the type having ignition distributor breaker contacts or contact sets mounted upon the rotatable breaker plate as it is well known in the prior automotive art. It is to be specifically understood, however, that this system is equally suitable for use with modern magnetic pickup type ignition distributors which produce ignition pulses to initiate an ignition spark. It is only necessary that the ignition spark initiating mechanism for initiating the generation of an ignition spark potential for each cylinder of and in timed relationship with the associated engine be of the type which is operable to vary the time or engine crankshaft angle at which each ignition spark potential is initiated.

As point of reference or ground potential is the same point electrically, it has been illustrated in FIG. 2 by the accepted schematic symbol and referenced by the numeral 5.

Referring to FIG. 1 of the drawing, reference numeral 10 designates the housing of a conventional ignition distributor and reference numeral 11 designates a distributor shaft which is journaled for rotation by and in timed relationship with an associated internal combustion engine 20 in a manner well known in the automotive art. Mounted upon and arranged to be rotated with distributor shaft 11 is a distributor cam 12 having a lobe corresponding to each cylinder of engine 20. To initiate an ignition spark for each cylinder of engine 20, a pair of ignition distributor breaker contacts, stationary contact 13 and movable contact 14, are provided. Movable contact 14 is carried by a breaker arm 15 pivotally mounted upon a pivot pin 16 and stationary contact 13 is rigidly secured to a rotatable breaker plate 17 as is pivot pin 16. Rotatable breaker plate 17 is arranged to be revolved about distributor shaft 11 and cam 12 in a plane normal to the longitudinal axis of distributor shaft 11. A rubbing block 18 is secured to breaker arm 15 by riveting or any other acceptable means and is maintained in intimate contact with distributor cam 12 by spring 19. This is a conventional automotive type ignition distributor ignition spark timing arrangement well known in the art.

As distributor cam 12 is rotated by distributor shaft 11, ignition distributor breaker contacts 13 and 14 are operated open and closed as the lobes of distributor cam 12 approach and pass by rubbing block 18. Upon each operation of ignition distributor breaker contacts 13 and 14 to the electrical circuit open condition, the ignition coil primary winding 27 energizing circuit, which may be traced in FIG. 2 from the positive polarity output terminal of battery 6, through primary winding 27, ignition distributor breaker contacts 13 and 14 and point of reference or ground potential 5 to the negative polarity terminal of battery 6, is interrupted. Upon each interruption of the ignition coil primary winding 27 energizing circuit, an ignition spark creating potential is induced in secondary winding 28 which is directed to the cylinder of engine 20 next to be fired through the rotatable output electrode 29 of the ignition distributor. Ignition distributor breaker contacts 13 and 14, breaker arm 15 and rotatable breaker plate 17, therefore, comrpise an ignition spark initiating mechanism for initiating the generation of an ignition spark creating potential for each cylinder of and in timed relationship with engine 20. This ignition spark initiating mechanism is rotatable as a unit about the longitudinal axis of distributor shaft 11 and cam 12, consequently, the engine crankshaft position at which each ignition spark is initiated may be varied by rotating the ignition spark initiating mechanism as any rotation thereof changes the time, relative to engine crankshaft position, that a lobe of cam 12 passes beneath rubbing block 18. As the ignition spark initiating mechanism is rotated in a direction the same as the direction of rotation of distributor cam 12, each ignition spark creating potential is produced at a later time relative to engine crankshaft position, ignition spark retard, and as the ignition spark initiating mechanism is rotated in a direction opposite the direction of rotation of distributor cam 12, each ignition spark creating potential is produced at an earlier time relative to engine crankshaft position, ignition spark advance. Therefore, the ignition spark initiating mechanism of FIG. 1 for initiating the generation of an ignition spark creating potential for each cylinder of and in timed relationship with engine 20 is of the type which is operable to vary the time each ignition spark potential is created by rotating the rotatable breaker plate 17 upon which stationary ignition distributor breaker contact 13 and the pivotally mounted breaker arm 15 which carries the movable distributor breaker contact 14 are mounted.

In FIG. 1, distributor shaft 11 and cam 12 are indicated to be rotated by engine 20 in a counterclockwise direction. Therefore, to provide ignition spark advance, breaker plate 17 is rotated in a clockwise direction and to provide ignition spark retard, breaker plate 17 is rotated in a counter-clockwise direction, as indicated. It is to be specifically understood, however, that distributor shaft 11 and cam 12 may be rotated in a clockwise direction in which case breaker plate 17 would be revolved in a counterclockwise direction for ignition spark advance and in a clockwise direction for ignition spark retard.

Internal combustion engine 20 is equipped with an intake manifold 21 and a carburetor 22 mounted upon intake manifold 21 in a conventional manner. A throttle lever 23, which may be foot operated by the operator within the passenger compartment in a manner well known in the automotive art, is secured through a link 24 to the throttle valve 25 of carburetor 22. In FIG. 1, throttle valve 25 is shown to be in full open throttle position. In this position, the engine intake manifold is at substantially atmospheric pressure. To decelerate the engine, pressure is released from throttle lever 23 which permits link member 24 to rotate in a counterclockwise direction, as viewing FIG. 1, to close throttle valve 25. The closing of throttle valve 25 results in an increase of intake manifold or engine vacuum as throttle valve 25 approaches the full closed position. With engine idle conditions, engine intake manifold or engine vacuum may be of the order of thirteen to fifteen inches of mercury. Mounted atop carburetor 22 is a conventional automotive type air cleaner 26 which provides a passage for engine intake air.

The ignition spark initiating mechanism of the ignition distributor may be rotated about the longitudinal axis of distributor shaft 11 and cam 12 in response to changes of intake manifold or engine vacuum by a vacuum responsive device such as a vacuum actuator unit 30. Vacuum actuator unit 30 has an operating rod 31; a two-piece outer casing **32*a* and 32*b* defining an enclosed space; a flexible diaphragm member 33 having opposite flat face surfaces located within the enclosed space and so positioned that it divides the enclosed space into a first chamber 34 exposed to atmosphere through port 35 and a second vacuum chamber 36 and a vacuum port 37 which opens into vacuum chamber 36. A helical compression spring 38 is located within vacuum chamber 36 and is so positioned that the opposite ends thereof mechanically engage, respectively, the rear end wall interior surface of outer casing 32*a* and the inner flat face surface of diaphragm 33 in such a manner that the compressive force thereof is exerted upon diaphragm member 33 in the direction along the longitudinal axis of compression spring 38 whereby diaphragm 33 is urged in a direction toward chamber 34. Vacuum actuator unit 30 may be mounted upon distributor housing 10 by a mounting bracket 39 in a manner well known in the art. Operating rod 31 is in operating engagement with both the ignition spark initiating mechanism of the ignition distributor and flexible diaphragm 33. To operatively couple operating rod 31 to the ignition spark initiating mechanism, the end thereof remote from diaphragm 33 pivotally engages a pin 40 secured to rotatable breaker plate 17. As pin 40 is located off the center of rotation of breaker plate 17, as operating rod 31 is operated in a linear direction along the longitudinal axis of diaphragm 33, breaker plate 17** is rotated about the center of rotation thereof.

Vacuum chamber 36 is in vacuum communication with intake manifold 21 of engine 20 through vacuum line 45 which includes a calibrated restriction 46, "T" connector 47, vacuum line 48 and vacuum port 37. Intake manifold or engine vacuum, therefore, is exposed to diaphragm 33 and chamber 34 is at atmosphere. The engine vacuum signal of intake manifold 21, therefore, is applied to vacuum actuator unit 30 through the vacuum connection hereinabove described.

As ignition distributor cam 18 is rotated in a counterclockwise direction, as illustrated by the arrow of FIG. 1, changes of the engine vacuum signal which produce a clockwise rotation of the ignition spark timing mechanism result in the initiating of ignition spark potentials at times earlier relative to engine crankshaft position and changes of the engine vacuum signal which produce a counterclockwise rotation of the ignition spark timing mechanism result in the initiation of ignition spark potentials at times later relative to engine crankshaft position.

Although the engine vacuum signal is herein indicated to be engine intake manifold vacuum, it is to be specifically understood that any other vacuum signal indicative of engine vacuum, such as a carburetor vacuum port, may be employed as the vacuum signal without departing from the spirit of the invention.

Figure 3:
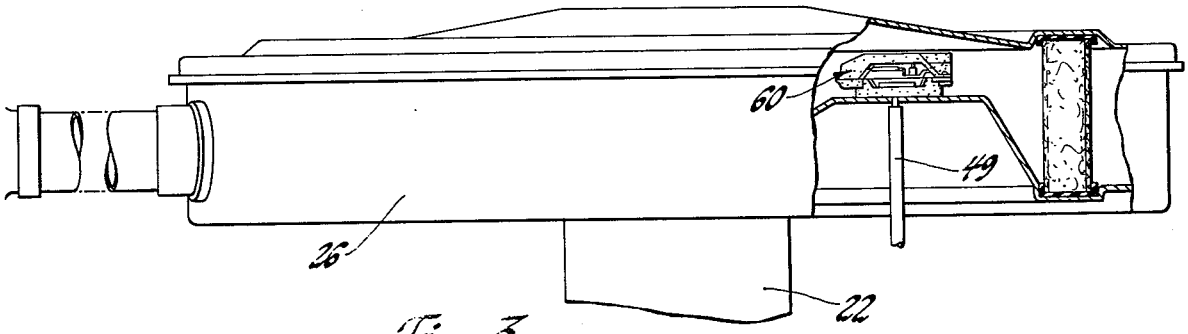
FIG. 3 illustrates the positioning of the temperature responsive valve used with the system of FIG. 1.

A temperature responsive valve, generally illustrated at 60, is located in a position in which it is exposed to engine intake air. Without intention or inference of a limitation thereto, the temperature responsive valve 60 may be mounted in a position within air cleaner 26 in which it is in the engine intake air passage as is illustrated in FIG. 3. It is to be specifically understood, however, that temperature responsive valve 60 may be located in other positions in which it is exposed to engine intake air without departing from the spirit of the invention. Temperature responsive valve 60 is of the type which automatically operates to the closed position with engine intake air temperatures less than a predetermined value and operates open by an amount proportional to the number of degrees the engine intake air is greater than the predetermined value. One example, and without intention of inference of a limitation thereto, of a valve of this type is the bi-metal strip proportional actuator type such as that shown and described in U.S. Pat. No. 3,459,163, Lewis, which issued Aug. 5, 1969 and is assigned to the same assignee as is this application. A bi-metal strip 61 is rigidly secured by a rivet 62 to a metallic base member 63, the end 61*a* of bi-metal strip 61 being free to move in a vertical direction as viewing FIG. 1. A valve member 64 is located by thermostatically responsive bi-metallic strip 61 in a position in which it may operatively engage valve seat 65 which is shaped to conform to the head portion 66 of valve member 64. Bi-metallic strip 61 is so oriented that with engine intake air temperature less than the predetermined value, the head 66 of valve member 64 is maintained in tight sealing fit with valve seat 65 and that with an increase of engine intake air temperature, end 61*a* thereof moves in a downward direction, as looking at FIG. 1, which permits head 66 of valve member 64 to move away from valve seat 65 by an amount proportional to the number of degrees of engine air intake temperature greater than the predetermined value. With this arrangement, therefore, temperature responsive valve 60 automatically operates to the closed position with engine intake air temperature less than a predetermined value and operates open proportionally to the number of degrees of engine intake air temperature greater than the predetermined value. It is to be specifically understood that temperature responsive valving arrangements other than that herein described may be employed, it being important only that the valve open proportionally to engine intake air temperature greater than a predetermined value.

In cooperation with temperature responsive valve 60 is a calibrated restriction 70 input to valve 60 in vacuum bleed line 49 extending between "T" connector 47 and the valve 60 input port 67. With this arrangement, the vacuum signal of engine intake manifold 21 is exposed to atmosphere through vacuum bleed line 49, calibrated restriction 70 and the outlet port 68 of temperature sensitive valve 60 which is open to atmosphere when valve member 64 is operated to the open position proportionally with engine intake air temperatures. The combination of calibrated restriction 46, calibrated restriction 70 and the proportioning temperature responsive valve 60 are operative in combination for adjusting the level of the engine vacuum signal is applied to vacuum actuator unit 30 in a direction toward atmosphere as the temperature of the engine intake air increases and vice versa.

Figure 5:
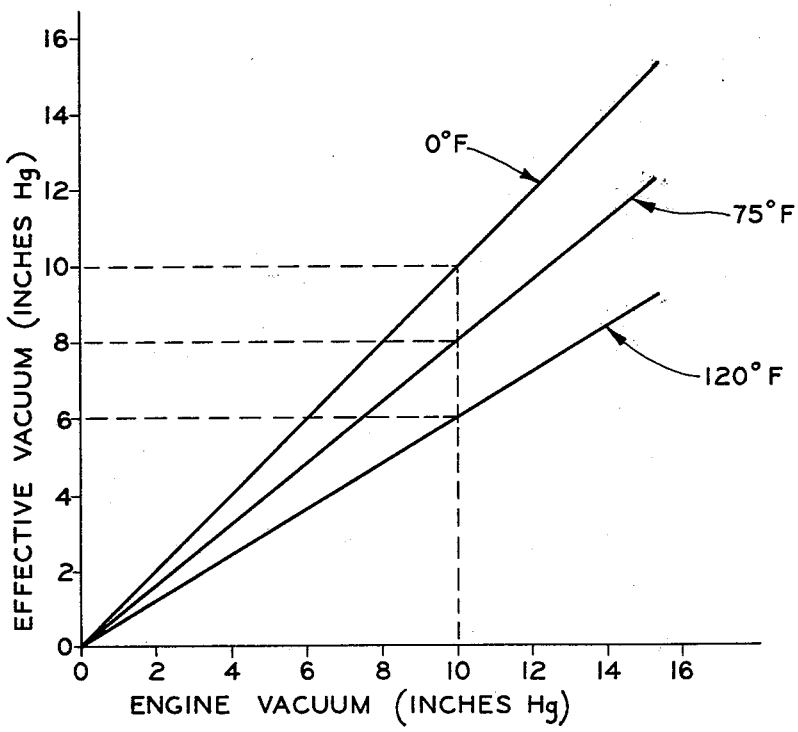
FIG. 5 is a set of curves indicating the effective vacuum versus the actual manifold vacuum at different engine intake air temperatures.

Calibrated restrictions 46 and 70 and the valving arrangement of temperature responsive valve 60 are so proportioned relative to each other that the effective vacuum signal applied to vacuum actuator unit 30 is adjusted toward atmosphere as engine intake air temperatures increase and vice versa as is illustrated in FIG. 5 wherein the effective vacuum signal in inches of mercury is plotted against the engine vacuum signal in inches of mercury.

Figure 4:
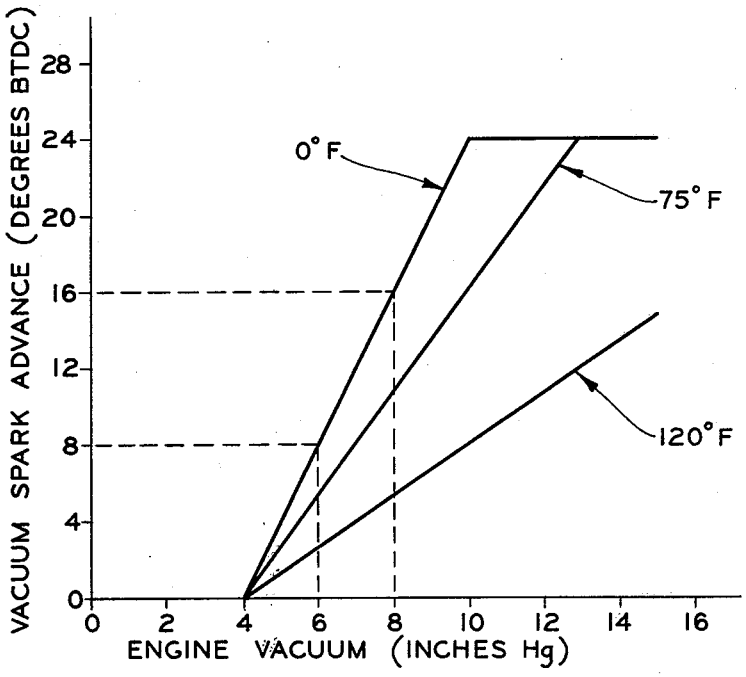
FIG. 4 is a set of ignition spark advance curves for various values of manifold vacuum at different engine intake air temperatures.

In a practical application of the temperature compensated internal combustion engine ignition spark vacuum advance system of this invention, it was empirically determined that, with engine intake air temperatures of 0° F. and less, the engine with which the system was employed required no vacuum advance until the engine vacuum signal was of a level of four inches of mercury, hereinafter referred to as the vacuum advance cut-in point. Further, it was determined that at 0° F. the engine required four engine crankshaft degrees ignition spark vacuum advance per inch of mercury engine vacuum greater than the four inches of mercury vacuum advance cut-in point to a maximum of twenty-four engine crankshaft degrees at ten inches of mercury engine vacuum; that at 75° F. the engine required two and two-thirds engine crankshaft degrees ignition spark vacuum advance per inch of mercury engine vacuum greater than the four inches of mercury vacuum advance cut-in point and that at 120° F. the engine required one and one-third engine crankshaft degrees ignition spark vacuum advance per inch of mercury engine vacuum greater than the four inches of mercury vacuum advance cut-in point. The vacuum advance curves for this engine at 0° F., 75° and 120° F. are set forth in FIG. 4 wherein the ignition spark vacuum advance in engine crankshaft degrees before top dead center is plotted against engine vacuum in inches of mercury. The helical compression spring 38 of the vacuum actuator unit 30 employed in this application has a spring rate which produces four engine crankshaft degrees ignition spark vacuum advance per inch of mercury engine vacuum between 4 and 10 inches of mercury vacuum. This vacuum actuator unit, therefore, produces an ignition spark vacuum advance which follows the 0° F. curve of FIG. 4. To properly calibrate the calibrated restrictions 46 and 70 with the valving arrangement of temperature responsive valve 60, a constant ten inches of mercury vacuum was pulled upon vacuum line 45. As has been previously brought out, at 75° F. the engine employed with this application required two and two-thirds engine crankshaft degrees ignition spark vacuum advance per inch of mercury engine vacuum greater than the 4 inches of mercury vacuum advance cut-in point which is sixteen engine crankshaft degrees ignition spark vacuum advance at ten inches of mercury vacuum. Referring to FIG. 4, to produce sixteen engine crankshaft degrees ignition spark vacuum advance, the vacuum actuator unit employed required eight inches of mercury vacuum. Therefore, calibrated restrictions 46 and 70 were so calibrated relative to each other and the valving arrangement of temperature responsive valve 60 exposed to 75° F. ambient temperature air that the effective vacuum signal applied to vacuum actuator unit 30 was eight inches of mercury vacuum, as illustrated by the 75° F. curve of FIG. 5. As also has been previously brought out, at 120° F. the engine required one and one-third engine crankshaft degrees vacuum advance per inch of mercury engine vacuum greater than four inches of mercury vacuum advance cut-in point which is eight engine crankshaft degrees ignition spark vacuum advance at ten inches of mercury vacuum. Referring to FIG. 4, to produce eight engine crankshaft degrees ignition spark advance, the vacuum actuator unit employed required six inches of mercury vacuum. Therefore, calibrated restrictions 46 and 70 were so calibrated relative to the valving arrangement of temperature responsive valve 60 exposed to 120° F. ambient temperature air that the effective vacuum signal applied to vacuum actuator unit 30 was 6 inches of mercury vacuum, as shown in FIG. 4. In the practical application, calibrated restriction 46 was 0.055 inch diameter and calibrated restriction 70 was 0.043 inch diameter.

As is illustrated in FIG. 5, calibrated restrictions 46 and 70 and the valving arrangement of temperature responsive valve 60 operate in combination for adjusting the level of the engine vacuum signal as applied to vacuum actuator unit 30 proportionally with changes of engine intake air temperature in a direction toward atmosphere as engine intake air temperature increases and vice versa. The three curves of 0°, 75° and 120° F. of FIG. 4 represent only three of a family of curves between 0° and 120° F.

As the engine intake air temperature increases form 0° F., the valving arrangement of the temperature sensitive valve 60 exerts the most influence in adjusting the level of the engine vacuum signal and as the engine intake air temperature continues to increase toward 120° F., the calibrated restriction 70 becomes the greater influence in adjusting the level of the engine vacuum signal. Calibrated restriction 46 is necessary because the engine 20 is such a good vacuum pump that without this calibrated restriction, the engine would completely overcome the effect of calibrated restriction 70 and the temperature responsive valve 60 valving arrangement.

While engine 20 is operating with conditions of engine intake air temperature of 0° F. or less, the ignition spark vacuum advance follows the 0° F. curve of FIG. 4, while the engine operating with conditions of engine intake air temperature of 75° F., the ignition spark vacuum advance follows the 75° F. curve of FIG. 4 and while the engine operating under conditions of engine intake air temperatures of 120° F., the ignition spark vacuum advance follows the 120° F. curve of FIG. 4. For intermediate temperatures between 0° and 110° F., the ignition spark vacuum advance follows similar linear curves of the same family of curves.

From this description, it is apparent that the temperature compensated internal combustion engine ignition spark vacuum advance system of this invention provides an ignition spark vacuum advance curve for each engine intake air temperature as determined by engine performance.

While a preferred embodiment of the present invention has been shown and described, it will be obvious to those skilled in the art that various modifications and substitutions may be made without departing from the spirit of the invention which is to be limited only within the scope of the appended claims.

What is claimed is:

1. A temperature compensated internal combustion engine ignition spark vacuum advance system comprising in combination with an associated internal combustion engine having an intake air passage: an engine vacuum signal source; an ignition spark initiating mechanism operated by a vacuum responsive device for adjusting ignition spark timing in response to changes of engine vacuum; means for applying said engine vacuum signal to said vacuum responsive device; and means responsive to engine intake air temperature for adjusting the level of said engine vacuum signal as applied to said vacuum responsive device proportionally with changes of engine intake air temperature, said last-named means being arranged to effect said adjustment in a direction toward atmosphere as the temperature of said engine intake air increases and vice versa.

2. A temperature compensated internal combustion engine ignition spark vacuum advance system comprising in combination with an associated internal combustion engine having an intake air passage; an engine vacuum signal source; an ignition spark initiating mechanism operated by a vacuum responsive device having a vacuum port for adjusting ignition spark timing in response to changes of engine vacuum; means for applying said engine vacuum signal to said vacuum port of said vacuum responsive device; and means including a temperature responsive valving arrangement exposed to engine intake air and a calibrated restriction input to said valving arrangement for adjusting the level of said engine vacuum signal as applied to said vacuum port of said vacuum responsive device proportionally with changes of engine intake air temperature, said last-named means being arranged to effect said adjustment in a direction toward atmosphere as the temperature of said engine intake air increases and vice versa.

3. A temperature compensated internal combustion engine ignition spark vacuum advance system comprising in combination with an associated internal combustion engine having an intake air passage: an engine vacuum signal source; an ignition spark initiating mechanism operated by a vacuum responsive device having a vacuum port for adjusting ignition spark timing in response to changes of engine vacuum; a vacuum line including a calibrated restriction for applying said engine vacuum signal to said vacuum port of said vacuum responsive device; and means including a temperature responsive valving arrangement exposed to engine intake air and a bleed line including a calibrated restriction for adjusting the level of said engine vacuum signal as applied to said vacuum port of said vacuum responsive device proportionally with changes of engine intake air temperature, said last-named means being arranged to effect said adjustment in a direction toward atmosphere as the temperature of said engine intake air increases and vice versa.

4. A temperature compensated internal combustion engine ignition spark vacuum advance system comprising in combination with an associated internal combustion engine having an intake air passage; an engine vacuum signal source; an ignition spark initiating mechanism operated by a vacuum responsive device having a vacuum port for adjusting ignition spark timing in response to changes of engine vacuum; a vacuum line including a calibrated restriction for applying said engine vacuum signal to said vacuum port of said vacuum responsive device; a temperature responsive valve having an inlet port, an outlet port exposed to atmosphere and a temperature responsive valving arrangement for said outlet port located in a position at which it is exposed to the air in said intake air passage of said engine, said temperature responsive valving arrangement being of the type which, when exposed to engine intake air temperatures less than a predetermined value, operates to close said outlet port and which, when exposed to engine intake air temperatures greater than said predetermined value, operates to open said outlet port by an amount proportional to the number of degrees of engine intake air temperature greater than said predetermined value; and a bleed line including a calibrated restriction arranged to bleed said vacuum signal to atmosphere through said inlet and outlet ports of said temperature responsive valve.

* * * * *